US005836501A

United States Patent [19]

Lai

[11] Patent Number: 5,836,501

[45] Date of Patent: Nov. 17, 1998

[54] SAFETY TRIGGER MECHANISM FOR STAPLER

[75] Inventor: Mei-Ling Lai, Taichung, Taiwan

[73] Assignee: Basso Industry Corp., Taichung, Taiwan

[21] Appl. No.: 880,552

[22] Filed: Jun. 23, 1997

[51] Int. Cl.[6] ..... B25C 1/04

[52] U.S. Cl. ..... 227/8; 227/130

[58] Field of Search ..... 227/8, 130

[56] References Cited

U.S. PATENT DOCUMENTS

| | | | |
|---|---|---|---|
| 4,378,084 | 3/1983 | Scala | 227/8 |
| 4,432,483 | 2/1984 | Kuck | 227/8 |
| 4,629,106 | 12/1986 | Howard et al. | 227/8 |
| 5,083,694 | 1/1992 | Lemos | 227/8 |
| 5,551,621 | 9/1996 | Vallee | 227/8 |
| 5,662,257 | 9/1997 | Mukoyama et al. | 227/8 |

*Primary Examiner*—Scott A. Smith
*Attorney, Agent, or Firm*—Charles E. Baxley, Esq.

[57] ABSTRACT

A safety trigger mechanism for a stapler includes a trigger member for pivotally coupling to the stapler at a pivot shaft and having an opening. A frame has a middle portion pivotally coupled to the trigger member at a pivot axle and having one end aligned with the opening of the trigger member for allowing the frame to be actuated by a slide of the stapler. A block is secured on the frame and has a recess for receiving a switch button of the stapler and for preventing the switch button from being actuated by the frame when the frame is not actuated, such that the staples may be prevented from being shot inadvertently.

3 Claims, 7 Drawing Sheets

SAFETY TRIGGER MECHANISM FOR STAPLER

BACKGROUND OF THE INVENTION

1. Field of the Invention

The present invention relates to a trigger, and more particularly to a safety trigger mechanism for stapler.

2. Description of the Prior Art

Typical staplers comprise a pressurized air for pressurizing the staples into a work piece. In order to prevent the staples from nailing onto the work piece, a number of safety devices have been developed for preventing the staples from being shot inadvertently. However, typical safety device for the staplers may not be easily manufactured.

The present invention has arisen to mitigate and/or obviate the afore-described disadvantages of the conventional trigger mechanisms for staplers.

SUMMARY OF THE INVENTION

The primary objective of the present invention is to provide a stapler having a safety trigger mechanism for preventing the staples from being shot inadvertently.

In accordance with one aspect of the invention, there is provided a safety trigger mechanism for a stapler, the safety trigger mechanism comprises a trigger body for pivotally coupling to the stapler at a pivot shaft and for allowing the trigger body to be rotated about the pivot shaft, the trigger body including an opening, a frame including a middle portion pivotally coupled to the trigger body at a pivot axle for allowing the frame to be rotated about the pivot axle, the frame including a first end aligned with the opening of the trigger body for allowing the frame to be actuated by a slide of the stapler, a block secured on the frame and including a recess for receiving a switch button of the stapler and for preventing the switch button from being actuated by the frame, and means for biasing the first end of the frame to engage with the opening of the trigger body. The recess of the block is provided for receiving the switch button and for preventing the block from engaging with and from actuating the switch button when the frame is not actuated.

The block is pivotally secured to the frame at the pivot axle, the block includes an engaging surface for engaging with the switch button, the frame includes a biasing means for biasing the block to engage with the frame.

The frame includes a pair of ears, the block is engaged between the ears of the frame and pivotally secured on the pivot axle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
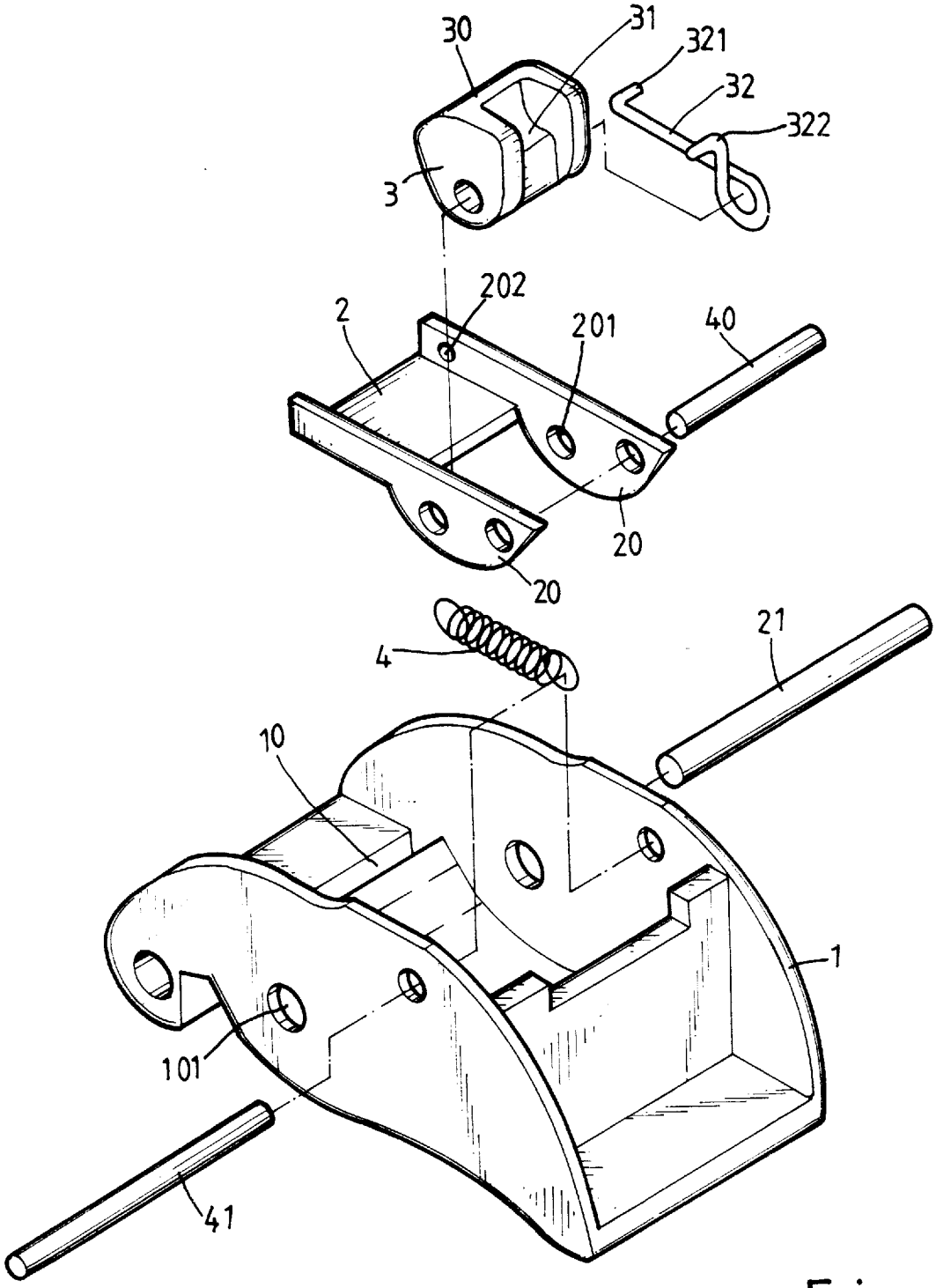
FIG. 1 is an exploded view of a safety trigger mechanism in accordance with the present invention.
Figure 2:
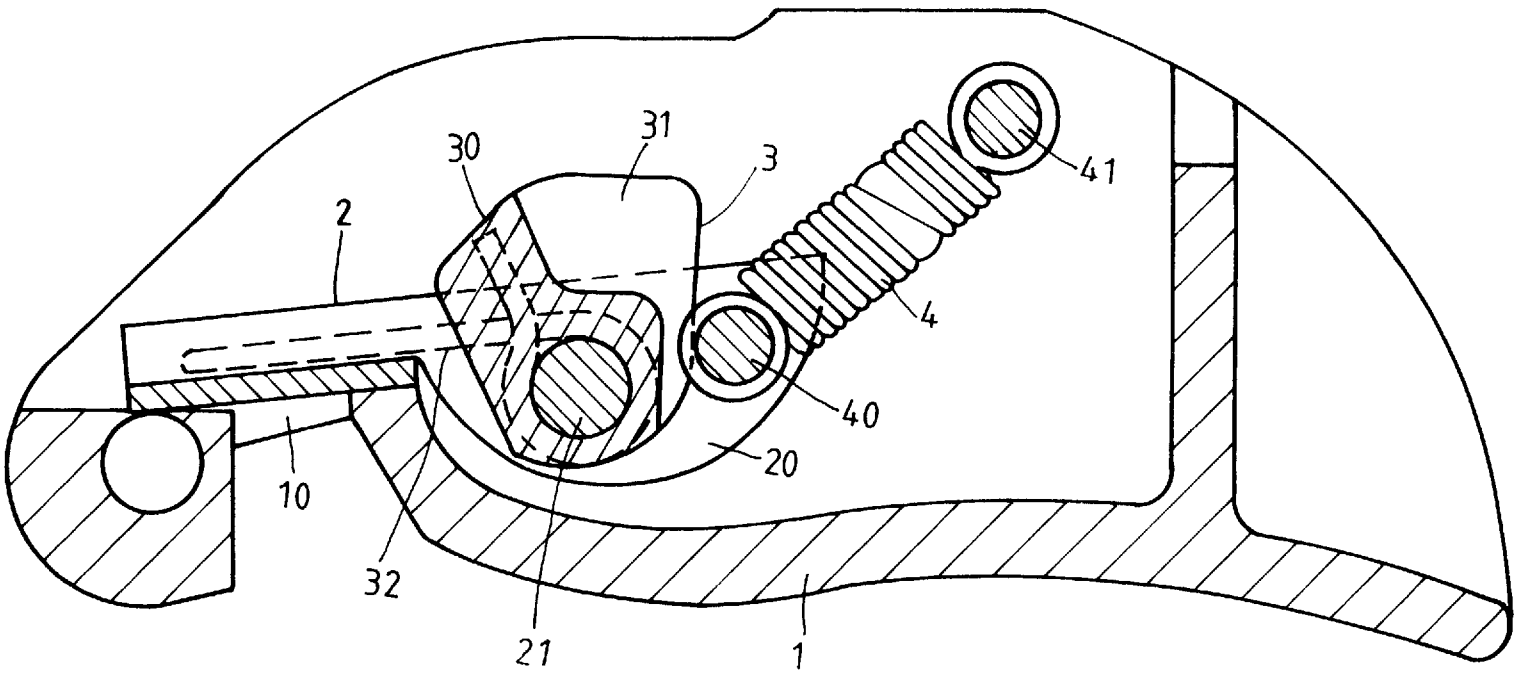
FIG. 2 is a cross sectional view of the safety trigger mechanism.
Figure 3:
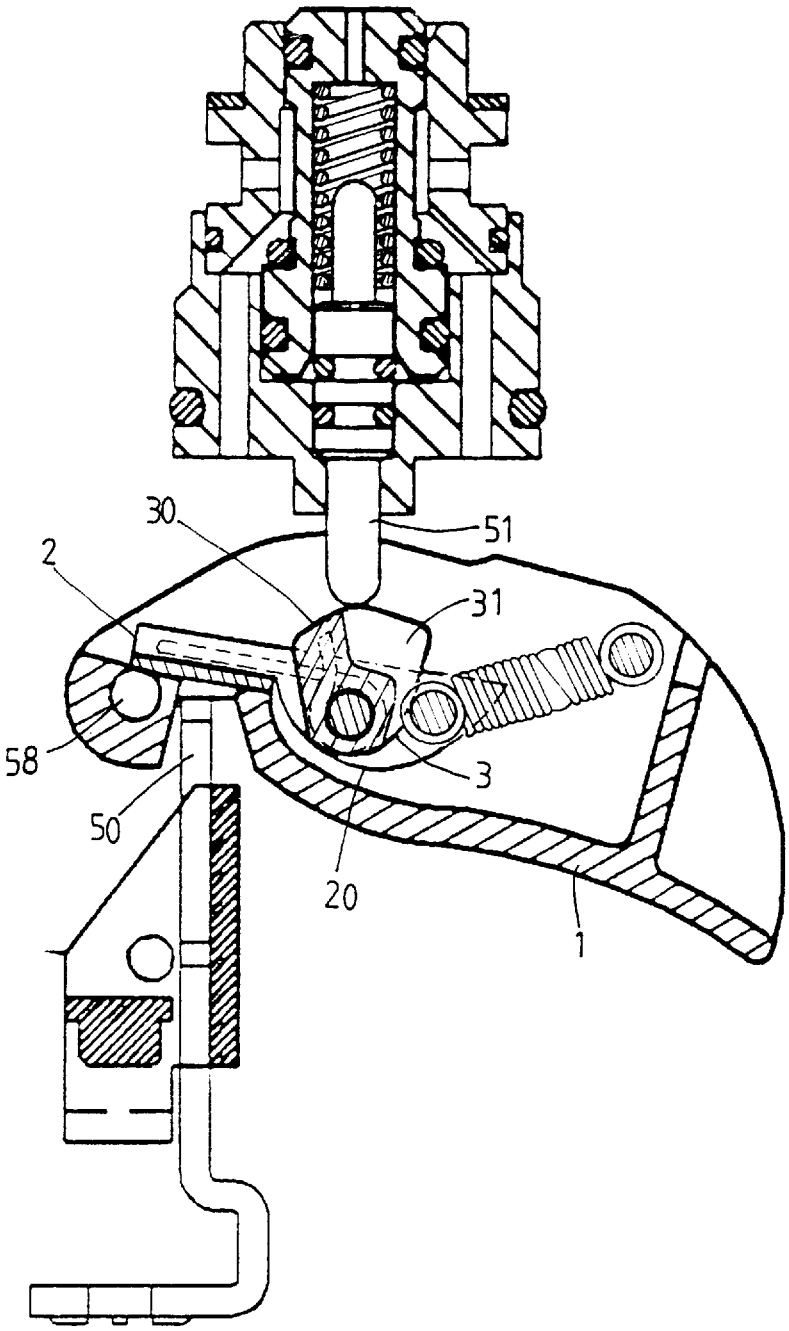
FIGS. 3, 4, 5, 6, 7 are cross sectional views illustrating the operation of the stapler.

Referring to the drawings, and initially to FIGS. 1–3, a safety trigger mechanism for a stapler in accordance with the present invention comprises a trigger body 1 pivotally coupled to the stapler at a pivot shaft 58 for allowing the trigger body 1 to be rotated about the pivot shaft 58. The trigger body 1 includes an opening 10 for slidable receiving a slide 50 which includes an upper end for engaging through the opening 10 and which includes a lower end for engaging with the work piece to be stapled. A frame 2 has two ears 20 and has a middle portion pivotally coupled to the trigger body 1 at a pivot axle 21 which is engaged through the holes 201, 101 of the frame 2 and the trigger body 1, for allowing the frame 2 to be rotated about the pivot axle 21. The slide 50 may engage through the opening 10 of the trigger body 1 for rotating the frame 2 about the pivot axle 21. A rod 40 is secured to the frame 2 and a post 41 is secured to the trigger body 1. A spring 4 is secured between the rod 40 and the post 41 for biasing the frame 2. A block 3 is disposed between the ears 20 of the frame 2 and is pivotally coupled to the frame 2 at the pivot axle 21 and includes an engaging surface 30 for engaging with and for actuating the switch button 51 of the stapler. The block 3 includes a recess 31 for receiving the switch button 51 and for preventing the switch button 51 from being actuated. A spring 32 is engaged on the pivot axle 21 and includes one end 321 engaged in the aperture 202 of the frame 2 and includes another end 322 engaged with the block 3 for biasing the block 3 toward the frame 2.

Figure 4:
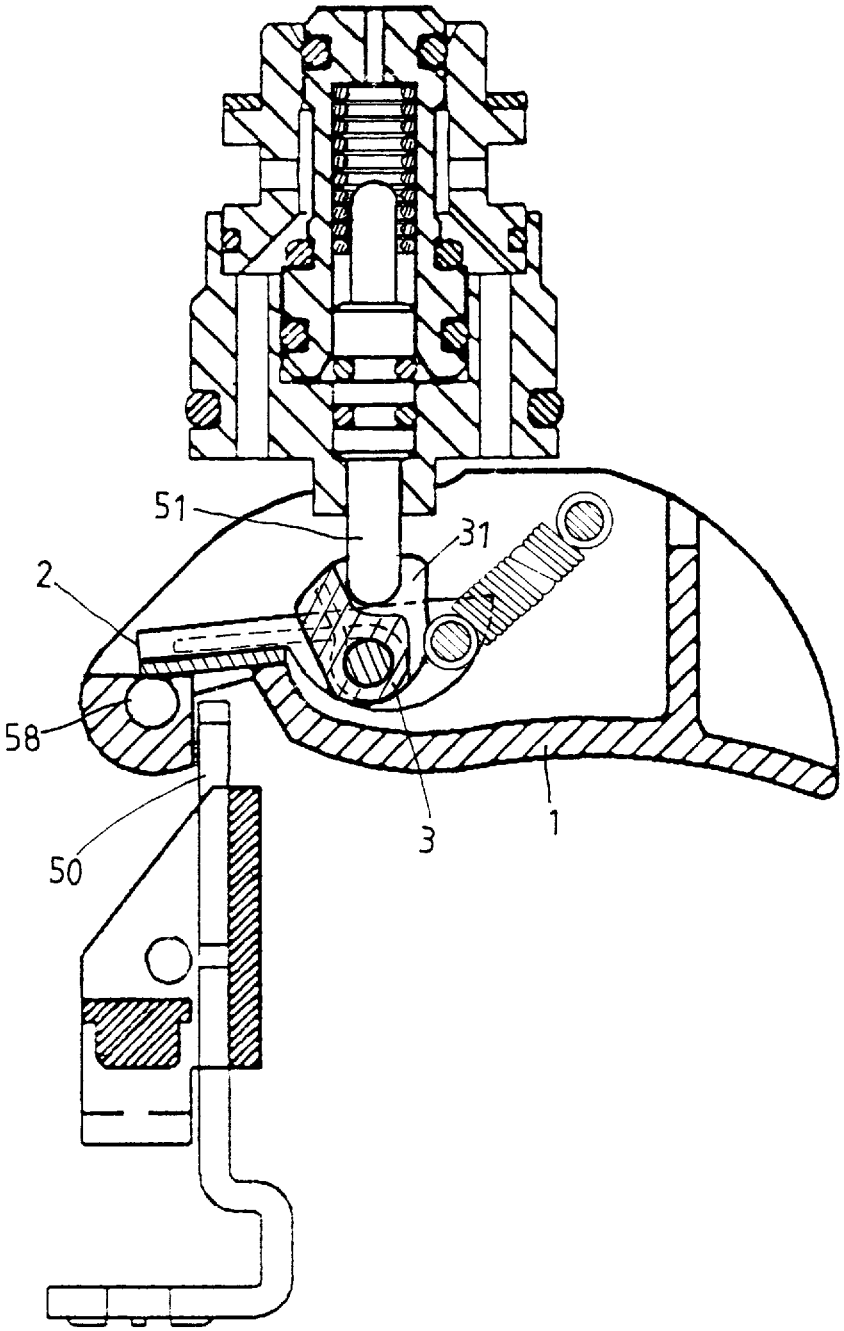
Figure 5:
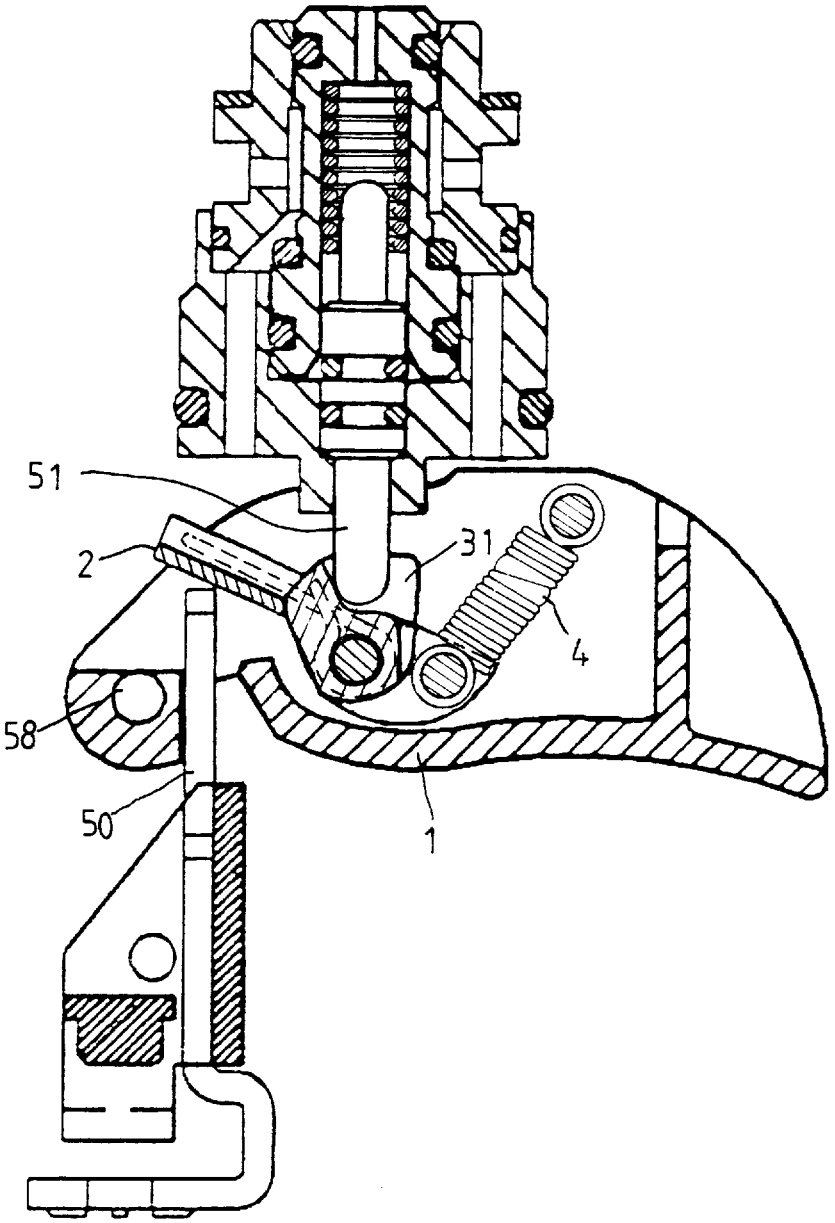

In operation, as shown in FIGS. 3 and 4, the switch button 51 will be engaged in the recess 31 of the block 3 when the frame 2 is not actuated by the slide 50 and when the trigger body 1 is rotated about the pivot shaft 58, such that the switch button 51 will not be actuated inadvertently by the user if the slide 50 has not been engaged with the work piece. As shown in FIG. 5, when the trigger body 1 is still pulled toward the switch button 51 and when the frame 2 is actuated by the slide 50 which is engaged through the opening 10 of the trigger body 1, the switch button 51 is still engaged in the recess 31 such that the switch button 51 also will not be actuated. It is to be noted that the trigger body 1 will be easily depressed by the user inadvertently. Accordingly, if the trigger body 1 is depressed before the slide 50 is engaged with the work piece, the switch button 51 will not be actuated inadvertently.

Figure 6:
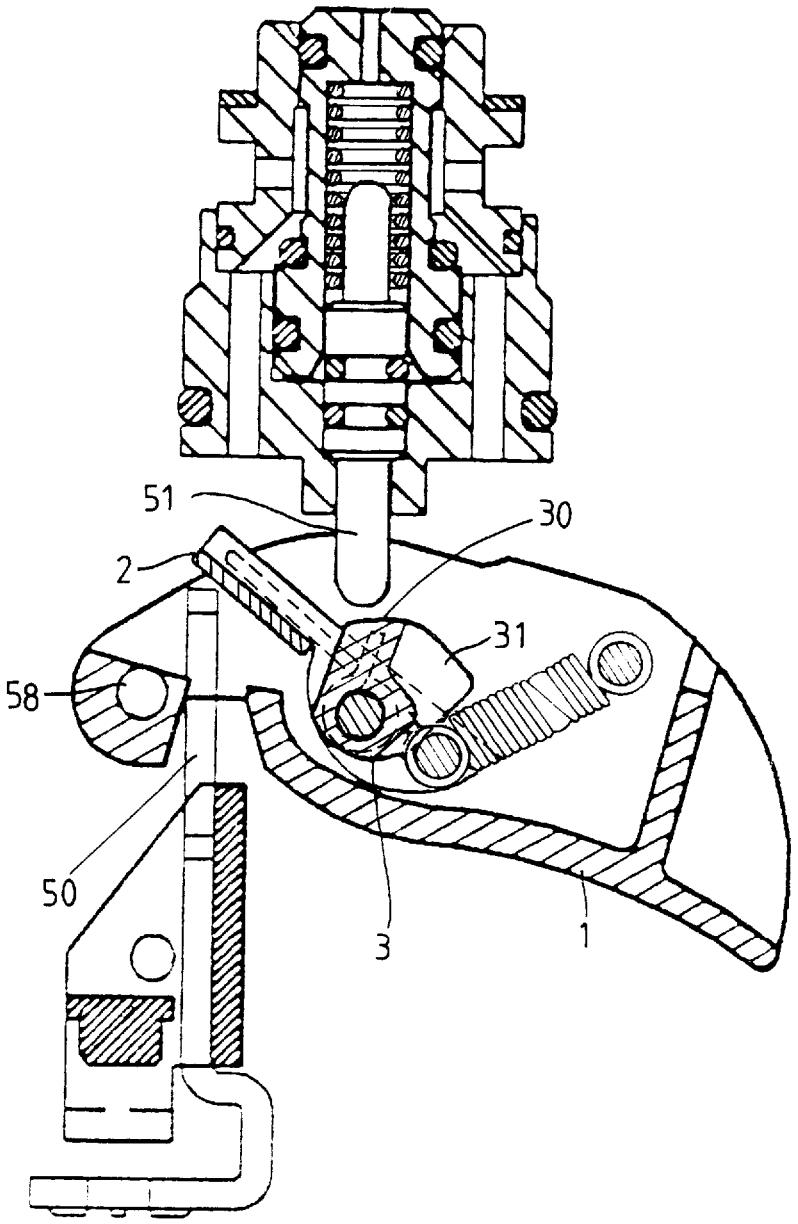
Figure 7:
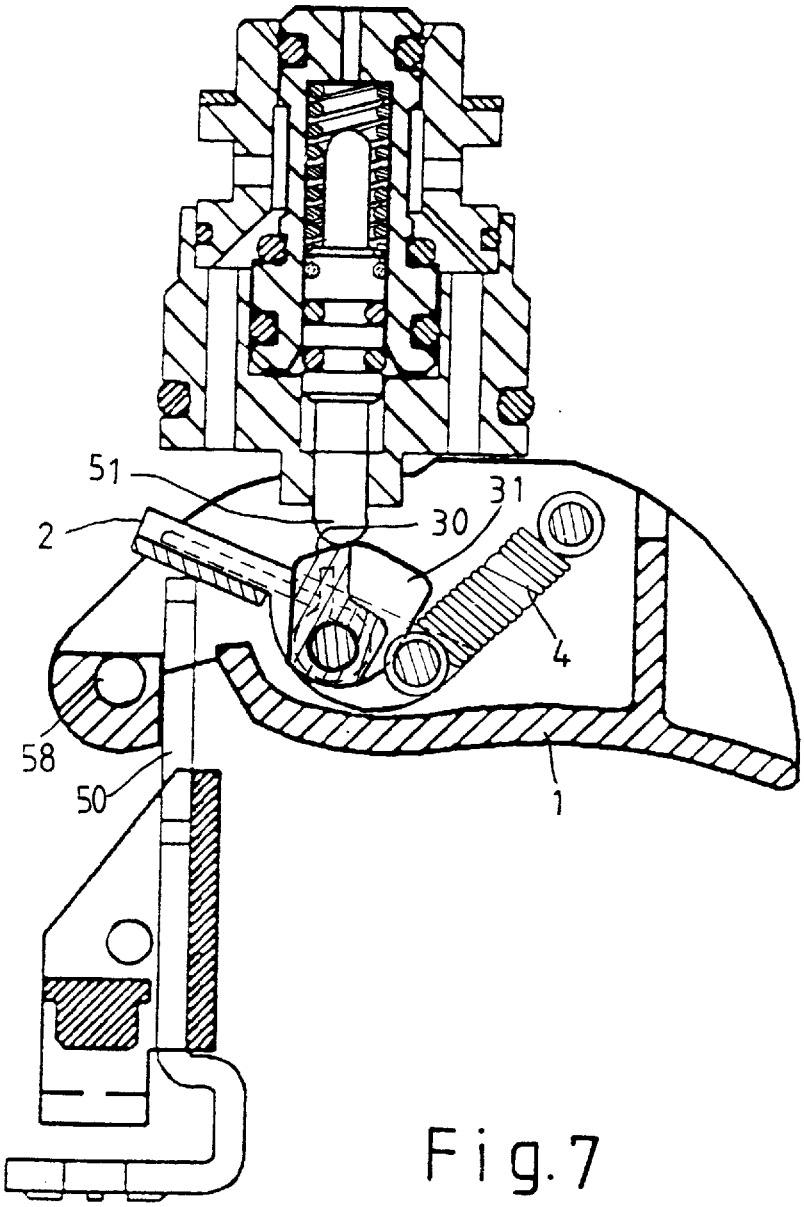

As shown in FIGS. 6 and 7, when the slide 50 is first engaged with the work piece and moves upward to actuate the frame 2, the engaging surface 30 is aligned with the switch button 51 for actuating the switch button 51 when the trigger body 1 is depressed or pulled toward the switch button 51. At this moment, the switch button 51 may be actuated by the trigger body 1. It is to be noted that the switch button 51 may still be actuated by the engaging surface 30 of the block 3 if the slide 50 is kept engaging with the work piece; i.e., if the frame 2 is kept depressed or actuated by the slide 50.

Accordingly, the safety trigger mechanism in accordance with the present invention includes a greatly simplified configuration which is excellent for manufacturing and assembling purposes. In addition, the safety trigger mechanism may prevent the staples from being shot inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A safety trigger mechanism for a stapler, the stapler including a switch button, said safety trigger mechanism comprising:

a trigger body for pivotally coupling to the stapler at a pivot shaft and for allowing said trigger body to be rotated about said pivot shaft, said trigger body including an opening, a frame including a middle portion pivotally coupled to said trigger body at a pivot axle for allowing said frame to be rotated about said pivot axle, said frame including a first end aligned with said opening of said trigger body, a block secured on said frame and including a recess for receiving the switch button of the stapler and for preventing the block from being actuated by the switch button, and means for biasing said first end of said frame to engage with said trigger body.

2. A safety trigger mechanism according to claim 1, wherein said block is pivotally secured to said frame at said pivot axle, said block includes an engaging surface for engaging with the switch button, said frame includes a biasing means for biasing said block to engage with said frame.

3. A safety trigger mechanism according to claim 1, wherein said frame includes a pair of ears, said block is disposed between said ears of said frame and pivotally secured on said pivot axle.

* * * * *